United States Patent [19]

Protacio et al.

[11] 4,374,507

[45] Feb. 22, 1983

[54] DEVICE FOR INTRODUCING ALCOHOL INTO GASOLINE ENGINE AS SUPPLEMENTAL FUEL

[75] Inventors: Alfredo C. Protacio, Project Sta. Barbara Sangley Point, Cavite City, Philippines; Ramon V. Navarro, Cavite City, Philippines; Eliseo M. Rio, Jr., Cavite City, Philippines; Antonio D. Alonte, Cavite City, Philippines; Felix J. Pascual, Cavite City, Philippines

[73] Assignee: Alfredo C. Protacio, Cavite City, Philippines

[21] Appl. No.: 158,695

[22] Filed: Jun. 12, 1980

[30] Foreign Application Priority Data

Jun. 18, 1979 [PH] Philippines ..... 22665

[51] Int. Cl.[3] ..... F02B 75/12

[52] U.S. Cl. ..... 123/1 A; 123/198 A

[58] Field of Search ..... 123/25 L, 25 R, 25 A, 123/1 A, 198 A

[56] References Cited

U.S. PATENT DOCUMENTS

| | | | |
|---|---|---|---|
| 2,300,774 | 11/1942 | Cartmell | 123/25 L |
| 2,602,435 | 7/1952 | Boyan | 123/25 R |
| 2,692,585 | 10/1954 | Dunnigan | 123/25 A |
| 3,537,434 | 11/1970 | Herpin | 123/25 L |
| 3,655,169 | 4/1972 | Goldfarb | 123/25 A |
| 3,716,040 | 2/1973 | Herpin | 123/25 R |
| 3,790,139 | 2/1974 | Stephenson et al. | 123/1 A |
| 3,856,901 | 12/1944 | Neumann et al. . | |
| 3,865,907 | 2/1975 | Rock | 123/25 L |
| 4,076,002 | 2/1978 | Mellqvist et al. | 123/25 L |
| 4,141,323 | 2/1979 | Hart | 123/25 B |

*Primary Examiner*—Charles J. Myhre
*Assistant Examiner*—E. Rollins Cross
*Attorney, Agent, or Firm*—Auslander, Thomas & Morrison

[57] ABSTRACT

A vapor generating device for volatile liquid such as alochol and the like, that can be attached to the carburation system of existing internal combustion engines in order to effectively facilitate the introduction of alcohol vapor inside the combustion chamber of the engine together with the atomized gasoline.

8 Claims, 2 Drawing Figures

DEVICE FOR INTRODUCING ALCOHOL INTO GASOLINE ENGINE AS SUPPLEMENTAL FUEL

BACKGROUND OF THE INVENTION

This invention relates to a device for introducing alcohol inside the combustion chamber of an internal combustion engine and more particularly to an alcohol vaporizing device that is attached to the carburation system of the engine, which can effectively introduce vaporized alcohol on a particular engine idling speed and release the said introduction of the alcohol vapor during deceleration. The alcohol vapors introduced act as supplementary fuel which displaces an equivalent amount of gasoline.

It is a common practice to blend a percentage of alcohol with gasoline in an alcogas mixture, the main purpose of which is to lesson one's dependency on imported fuel. However, direct gasoline-alcohol blends introduces operating difficulties, especially in starting, accelerating, and vapor lock. Aside from being more expensive, gasoline-alcohol blends gives increased fuel consumption than using pure gasoline. The handling and shipment of gasoline-alcohol blends are difficult because of the ease with which these components separate when traces of water are introduced. It is difficult to keep water out of bulk or storage tanks, filling-station tanks, and motor-car tanks and water entering the engine is harmful. In fact, mixing alcohol with gasoline is a very difficult and expensive process since anhydrous alcohol with almost no water content is needed for a successful mixture. Anhydrous alcohol is much more expensive than gasoline. Yet the use of ordinary alcohol to displace partly gasoline as motor fuel is a solution to the energy crises, as alcohol can be locally produced.

OBJECTIVES

The objectives of the invention are as follows:

1. to introduce alcohol as a vapor with the gasoline vapor into the engine, eliminating the entry of liquid water that might be present in alcohol;
2. to make the gasoline-alcohol-vapor combination comparable to if not better than pure gasoline in terms of cost and performance;
3. to allow high compression engines that use high octane gasoline to use lower-octane or regular gasoline without any engine adjustments, as it is a known fact that alcohol improves the anti-knock value and consequent efficiency of gasoline; and
4. to eliminate the tedious and expensive process of bulk mixing of alcohol with gasoline;

and 5. to minimize pollution because the emission of carbon moxide is almost zero.

VIEWS OF THE DRAWINGS

DETAILED DESCRIPTION

Figure 1:
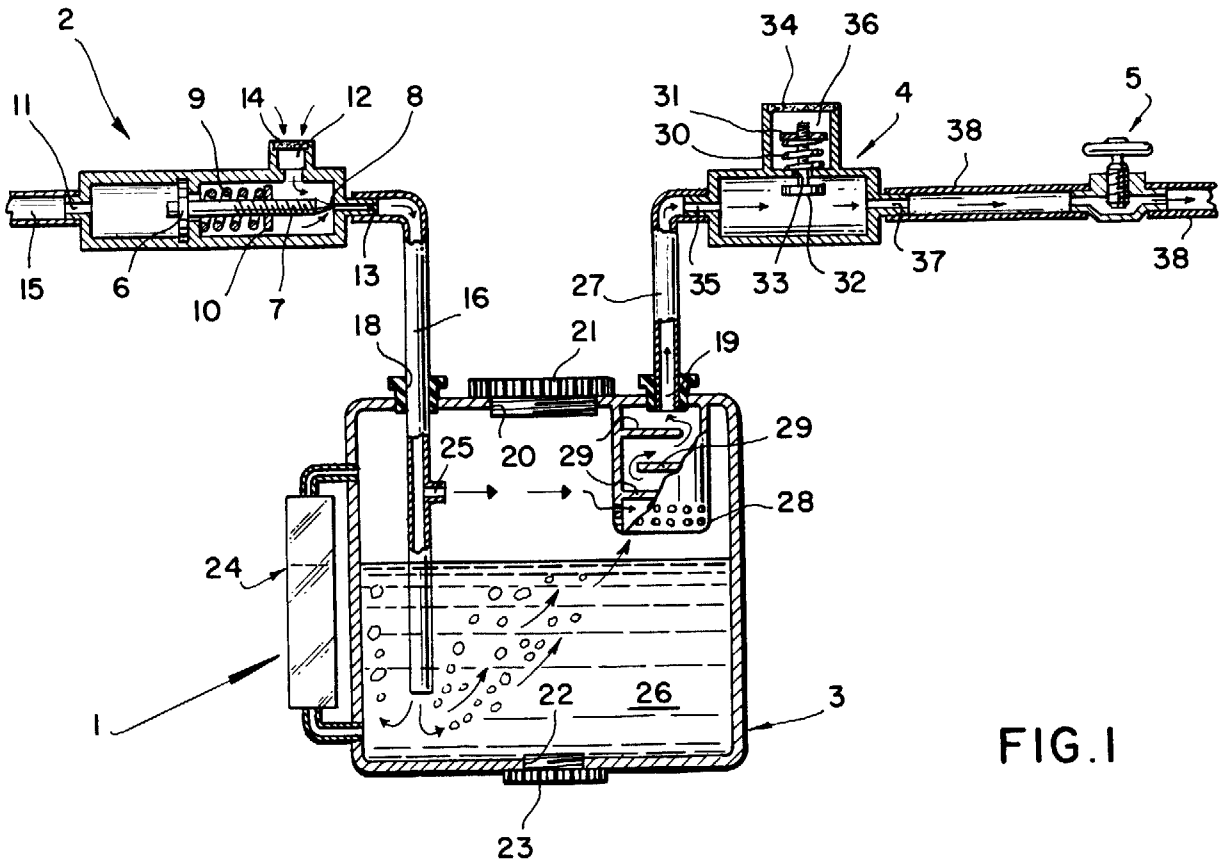
FIG. 1 is the diagramatic representation of the device of this invention.

Referring now to the drawings, there is shown a device 1 for introducing vaporized alcohol into a gasoline engine as a supplemental fuel comprising an alcohol vapor control valve 2, an alcohol vaporizing tank 3, a deceleration air feed valve 4, and a manual control valve 5.

The alcohol vapor control valve 2 may be constructed as a flexing diaphragm type, a plunger type or a bull type valve that can be actuated by means of the suction pressure coming from the intake manifold of an internal combustion engine. The manner of operation is similar to the automatic advancer of the distributor of an existing internal combustion engine which pulls a rod as the engine speeds up.

As shown in the drawing, the preferred valve 2 is of the flexing diaphragm type having a diaphragm 6 on which is attached an air entry valve 7 with a pointed end that is adapted to fit on a valve seat 8. The opening of the entry valve 7 is controlled by a compression spring 9 and an adjusting nut 10. The tension of the valve spring 9 is adjusted by the adjusting nut 10 such that the valve opening will be a factor of the vacuum pressure. This simply means that only at higher vacuum pressure will the control valve operate to open the air inlet port. The conditions of higher vacuum pressure existing in the intake manifold are when the throttling valve of the carburator is closed or when the throttling valve is fully open but the engine is revolving at high speed.

The control valve 2 has three openings 11, 12 and 13 which are adapted to be attached to a vacuum controlling ignition timing advance suction line 15, the air intake opening with filter 14, and the alcohol vaporizing tank 3 air inlet pipe 16, respectively. When air is sucked in by the advance suction line 15, the flexing diaphragm 6 is pulled backward against the pressure of the compression spring 9 and the valve 7 is pulled back in order to open the valve seat 8. At the open condition of the valve seat 8, fresh air are now allowed to flow from the air intake opening 12 towards the alcohol vaporizing tank 3.

The alcohol vaporization tank 3 is basically an enclosed container having an air inlet port 18, an air outlet port 19, a filling port 20 with screwable cap 21, and a drain port 22 with a drain plug 23. To provide a means whereby the content of the tank 3 can be seen, an alcohol level window 24 is attached on the wall of the said tank 3 thereby facilitating the visual indication of the level of the fluid inside the tank by means of the clear glass tubing. Fitted to the air inlet port 18 is the air inlet pipe 16 coming from the control valve 2 which extends close to the bottom of the tank. The pipe 16 has an open end but provided with a small air by-pass opening 25 at the upper portion thereof. The open end facilitates the bubbling thru the liquid alcohol of the fresh air coming from the atmosphere thru the control valve 2 while the small opening 25 allows small amount of air to pass thru the tank without passing thru the liquid alcohol. By this attachment of the air inlet pipe 16, it can be seen that when the suction pressure coming from the engine's intake manifold is low, fresh air is suck from the by-pass opening 25 only but when the suction pressure is very high, then air is suck from said opening 25 and the opened end of pipe 16 by way of the liquid alcohol 26. Fitted to the air outlet port 19 is the air outlet pipe 27 having a cylindrical baffle 28 at the end thereof. Said baffle 28 contains plurality of baffle plates 29 which increases the path of the vaporized alcohol. The baffle plates 29 also condense the saturated alcohol vapors and cause them to fall back inside the tank 3 rather than be suck by the engine in the liquid state.

The alcohol vaporizing tank 3 operates in this manner. The liquid alcohol 26 is poured inside the tank 3 to a pre-determined height by way of the filling port 20 and afterwards covered by the cap 21. Under ordinary atmospheric pressure there exists inside the tank 3 a minor evaporation of the liquid alcohol that is limited by the equalizing pressure inside the closed tank 3. When a slight suction pressure is applied to the tank, then the surface tension of the liquid alcohol becomes low and more evaporation of the liquid follows. At a stronger vacuum pressure, the air suck in are forced to bubble thru the liquid alcohol thereby increasing the surface areas whereby the liquid can freely evaporate. When this condition is attained, the air suck by the engine's manifold is a mixture of fresh air and alcohol vapors. To prevent heavy vapors and water vapors from being suct by the engine, the mixed vapors are passed thru a baffle 28 with plurality of baffle plates 29. These baffle plates increase the pathway of the traveling vapors on its upward travel. When the heavy vapors condense then it returns to liquid state and fall back to the tank. After a period of operation, the liquid alcohol will be depleted of its volatile components and a non-volatile residue will now be present at the bottom of the tank. This non-volatile residue is then discharged out from the tank 3 by means of the drain plug 23 and afterwards replaced by a new supply of fresh alcohol.

Figure 2:
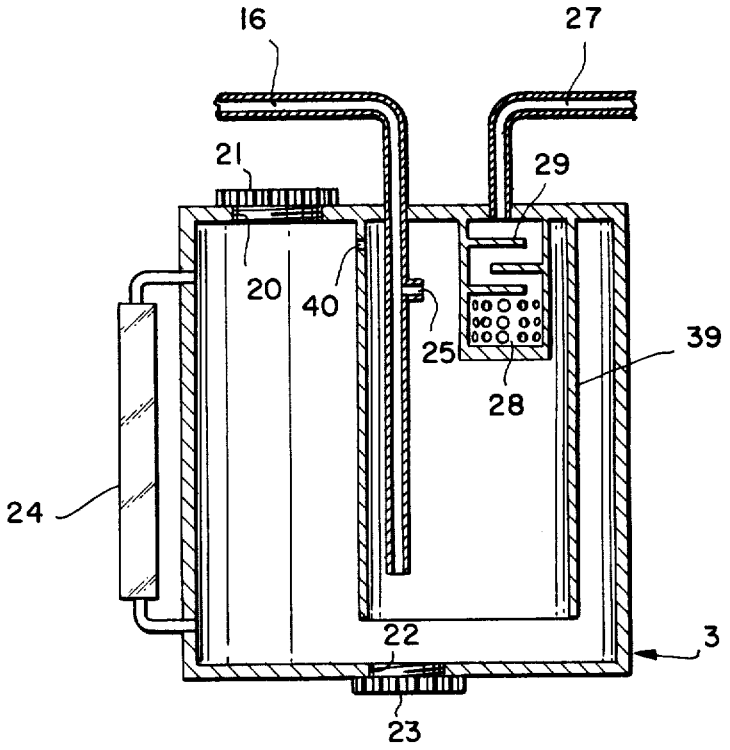
FIG. 2 is the cross-sectional view of another type of alcohol evaporator of this invention.

In FIG. 2 of the drawing, there is shown another specie of the alcohol vaporizing tank 3 that can be substituted to the vaporizing tank of FIG. 1 for more refined engine performance. In this particular tank the baffle 28 and the air inlet pipe 16 are both enclosed in a smaller cylindrical container 39 with an open bottom. The said bottom of the container 39 is open in order to facilitate the equalization of the liquid level inside the vaporizing tank. However, with the equalization of the liquid level the condition of pressures inside the tank will vary from one container to the other, so a small pinhole 40 is bored on the upper wall of the container 39 which can facilitate the stabilization of the pressures especially during evaporation wherein the liquid is agitated by the air bubbles.

The main purpose of the provision of a container 39 is just to limit the surface area of vaporization of the alcohol thereby preventing the possibility of running the engine. The operation of the evaporator is the same as the former tank 3 of FIG. 1 but with a limited emission of alcohol vapors.

The deceleration air feed valve 4 used in this invention is a one-way check valve that is again air pressure operated with the operating pressure being controlled by a light compression spring 30 and an adjusting nut 31. The valve 32 seats on an opening 33 that terminates on an opening having an air filter 34. The valve 4 functions to supply fresh air to the engine's intake manifold and at the same time releases the suction pressure of the tank 3 by the opening of the valve 32 at a pre-determined suction pressure from the engine's manifold. This valve 4 actuates when the engine is decelerating on a downhill in order to provide minimal supply of fuel to the combustion chamber for braking purposes. The air feed valve 4 has three openings 35, 36 and 37 which are attached to the outlet pipe 27 coming from the vaporizing tank 3, the air inlet port and the intake manifold pipe line 38.

The vacuum control 4 is provided so as not to generate a vacuum inside the alcohol tank 3 greater than what would be encountered when the engine is idling (around 17 inches of mercury). The valve is so adjusted that it starts to open whenever the engine vacuum exceeds the vacuum during idling (usually 16 to 18 inches of mercury). drawing air thru the air filter 34.

To provide a shut-off means whereby the device 1 may totally be made inoperative, as in the case of the inavailability of alcohol, then a manually operable valve 5 is placed in series with the suction pipe line 38 so that by merely turning the valve handle clockwise the said valve 5 will close.

OPERATION

The device operates in the following manner. At idling and starting, the vacuum controlling ignition advance is zero. Thus, the air entry valve 7 is closed. The vacuum in the intake manifold is not enough to open the vacuum control valve. Thus, at these conditions, no air passes through the alcohol tank 3 and no alcohol is used. When the driver steps on the accelerator, the vacuum now causes the diaphragm 6 to pull the valve 7 to open causing air to be sucked into the alcohol tank 17 due to the vacuum being exerted by the engine's intake. The mixture of alcohol-air ratio is adjusted by the by-pass port opening 25 depending on engine type. Thus, the amount of alcohol vapor introduced is a function of the vacuum controlling ignition timing advance. As ignition timing is advanced a higher octane fuel is needed to eliminate engine knock. Since alcohol is a very good anti-knock agent and is injected into the engine at precisely when needed, the gasoline used could be a regular or a low-octane one. Also, the vacuum controlling ignition timing advance is also a measure of engine loading. At heavy loads, the vacuum is low and at light loads this vacuum is high. In other words, thru this device, the proportion of gasoline with respect to alcohol is greater at heavy loads and lesser at lesser load. Since alcohol has a lower BTU rating than gasoline, the device introduces it only at lighter loads where it will enhance the gasoline more efficiently.

Having thus described the invention, what we claim as new is:

1. A device for introducing alcohol vapors together with gasolene vapors into the combustion chamber of an engine comprising:

a vapor control valve wherein the control element is connected to the intake manifold of the internal combustion engine having an air intake opening and an air output opening;

an air tight tank adapted to hold a volatile liquid such as alcohol and the like having a liquid inlet and a liquid outlet port and having an air inlet pipe connected to the air output opening of the vapor control valve, where the air inlet pipe has an opened end that allows the bubbling of air through the liquid alcohol and a by-pass opening that facilitates the flow of air on top of the volatile liquid and having an air outlet pipe whose inlet end is terminated by a cylindrical container with multiple holes and inter-layered inside with a plurality of baffle plates; and a deceleration air feed valve having its input connected to the air outlet pipe of the air tight tank and having an air inlet port and providing a check valve for supplying air to the engine upon reaching of a predetermined suction pressure from the engine's manifold in order to avoid generation of a vacuum inside the alcohol containing air tight tank.

2. A device as in claim 1 wherein the vapor control valve is a diaphragm valve.

3. A device as in claim 1 wherein the deceleration air feed valve comprises a compression spring and an adjusting element for setting the suction pressure required to induce opening of the valve and thereby to feed air to the engine's manifold.

4. A device as in claim 1 wherein the air feed deceleration valve comprises a filter disposed at the air inlet port for filtering the air.

5. A device as in claim 1 further comprising a drain plug at the bottom of the air tight tank.

6. A device as in claim 1 including a decceleration air feed valve attached between said vaporizing tank and the intake manifold, said valve being adapted to actuate when the engine vacuum exceeds the vacuum during idling which is usually 16 to 18 inches of mercury.

7. A device as in claim 6 including a manually operated control valve that is attached between the decceleration air feed valve and the intake manifold which is adapted to shut-off the air suction line when there is no available alcohol supply.

8. A device as in claim 6 wherein the alcohol vaporization tank contains an additional container whereby the area of vaporization can be limited.

* * * * *